US007584841B2

(12) United States Patent
Chan et al.

(10) Patent No.: US 7,584,841 B2
(45) Date of Patent: Sep. 8, 2009

(54) HOLDING DEVICE FOR HOLDING AND POSITIONING A PORTABLE OBJECT

(75) Inventors: James Chan, San Marino, CA (US); Saharut Sirichai, New Territories (HK)

(73) Assignee: Belkin International, Inc., Compton, CA (US)

( * ) Notice: Subject to any disclaimer, the term of this patent is extended or adjusted under 35 U.S.C. 154(b) by 294 days.

(21) Appl. No.: 11/649,969

(22) Filed: Jan. 5, 2007

(65) Prior Publication Data

US 2008/0164174 A1 Jul. 10, 2008

(51) Int. Cl.
*B65D 5/52* (2006.01)
*B65D 25/24* (2006.01)

(52) U.S. Cl. ..... 206/45.23; 206/45.28; 206/305; 206/723

(58) Field of Classification Search ..... 206/45.2, 206/736, 45.23, 45.24, 751, 752, 775, 779, 206/320, 576, 701, 45.21, 45.25, 45.28, 45.29, 206/305; 53/468, 492
See application file for complete search history.

(56) References Cited

U.S. PATENT DOCUMENTS

| | | | | |
|---|---|---|---|---|
| 1,189,531 | A * | 7/1916 | Bierwirth | 206/45.24 |
| 1,452,278 | A * | 4/1923 | Kind | 206/733 |
| 1,613,536 | A * | 1/1927 | Rose | 132/315 |
| 5,297,677 | A * | 3/1994 | Burian et al. | 206/362.4 |
| 6,270,226 | B1 * | 8/2001 | Taylor | 359/866 |
| 6,772,879 | B1 * | 8/2004 | Domotor | 206/45.23 |
| D501,718 | S | 2/2005 | Brown | |
| D519,275 | S * | 4/2006 | Shertzer | D3/218 |
| D543,023 | S | 5/2007 | Han et al. | |
| 2001/0035444 | A1 | 11/2001 | Alis | |
| 2006/0060476 | A1 * | 3/2006 | Lau | 206/45.25 |

* cited by examiner

*Primary Examiner*—Luan K Bui
*Assistant Examiner*—Chun Cheung
(74) *Attorney, Agent, or Firm*—Bryan Cave LLP

(57) ABSTRACT

A holding device 100 for holding a portable object 1000 is disclosed. More particularly, holding devices 100 for holding and positioning portable electronic devices are provided. Also provided are methods of manufacturing 600 and using 700 a device for holding and positioning 100 a portable object 1000.

32 Claims, 6 Drawing Sheets

HOLDING DEVICE FOR HOLDING AND POSITIONING A PORTABLE OBJECT

FIELD OF THE INVENTION

This invention relates generally to holding devices, and relates more particularly to holding devices for holding and positioning portable electronic devices.

BACKGROUND OF THE INVENTION

Electronic devices small enough to be used outside of a home or office environment are commonplace. Early versions of such electronic devices generally included only control surfaces, e.g., buttons and wheel controls. Modern versions of these, however, include graphical displays imparting information to the user and in many instances allowing for viewing of video or motion picture content. These devices are often so small and light that they can easily be carried in a pocket or purse, encouraging the use of cellular telephones, personal digital assistants (PDAs), digital music players, portable videogame systems, and similar electronic devices in almost any location.

Quick viewing of the graphical display of such portable devices is easily accomplished by holding the portable device in the hand and positioning for convenient viewing. However, holding the portable device in one's hand in this position for long periods of time is not convenient and is tiresome. Moreover, in the case where many people are viewing the graphical display, e.g., when viewing video or motion picture content, it can be difficult for one person to hold the portable device in hand and find a position where all of the viewers have a clear view of the graphical display. Moreover, holding the portable device in the hand interferes with the viewer's ability to undertake other tasks with the hands, e.g., note taking or typing. Accordingly, there exists a need for a holding device for holding a portable object, such as a portable electronic device, that allows for positioning of the portable object in a position that allows for hands-free operation and that is convenient for viewing the graphical display.

BRIEF DESCRIPTION OF THE DRAWINGS

The invention will be better understood from a reading of the following detailed description, taken in conjunction with the accompanying figures in the drawings in which.

Figure 2:
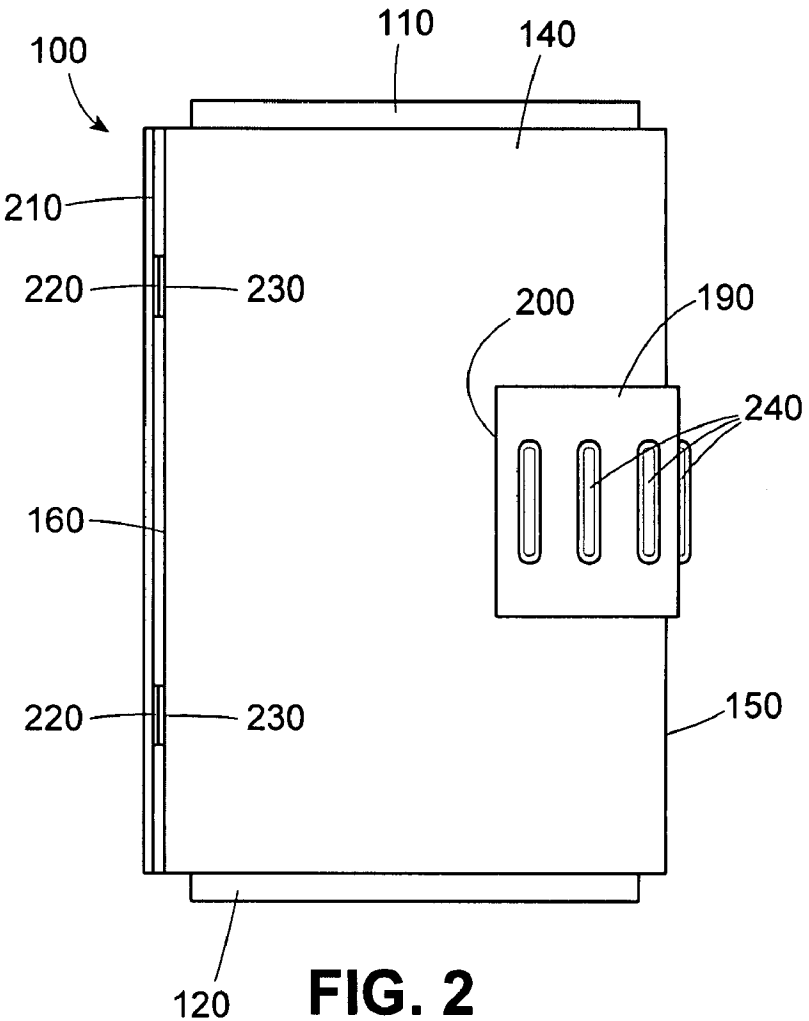
FIG. 2 is a view of the holding device of FIG. 1 in the closed position from the back.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, a holding device for holding and positioning a portable object comprises: a case having six sides, each side having an exterior and an interior surface; a first side of the case coupled only to a second side of the case; an elongate flap coupled to the first side of the case; a slot through the elongate flap; a tongue coupled to the exterior surface of the second side of the case at a first end and free at the second end with a length from the first end to the second end; and a fastener. The tongue passes though and frictionally engages the slot in the elongate flap. When closed, the first side of the case is positioned to form, with the five other sides of the case, a rectangular prism adapted to enclose the portable object; the elongate flap covers a side of the case that does not intersect with the second side of the case; the portion of the tongue from the point it is coupled to the exterior surface of the second side of the case to the point where the tongue passes through the slot in the elongate flap lies flat on or otherwise conforms to the shape of the exterior surface of the case; the portion of the tongue from the point it passes through the slot in the elongate flap to the free end lies flat on or otherwise conform to the interior surface of the case; and the fastener maintains the first side of the case and the elongate flap in the closed position. When open, the portion of the tongue from the slot to the free end is increased relative to when the case is in a closed position; the first side of the case and the elongate flap is folded to form an angle of less than 180 degrees and greater than 0 degrees with the second side of the case; this angle is maintained by the frictional engagement of the tongue by the slot; and when rested on a surface, the first side of the case and the elongate flap and the second side of the case form a platform on which the portable object is in a position not parallel to the surface.

Figure 1:
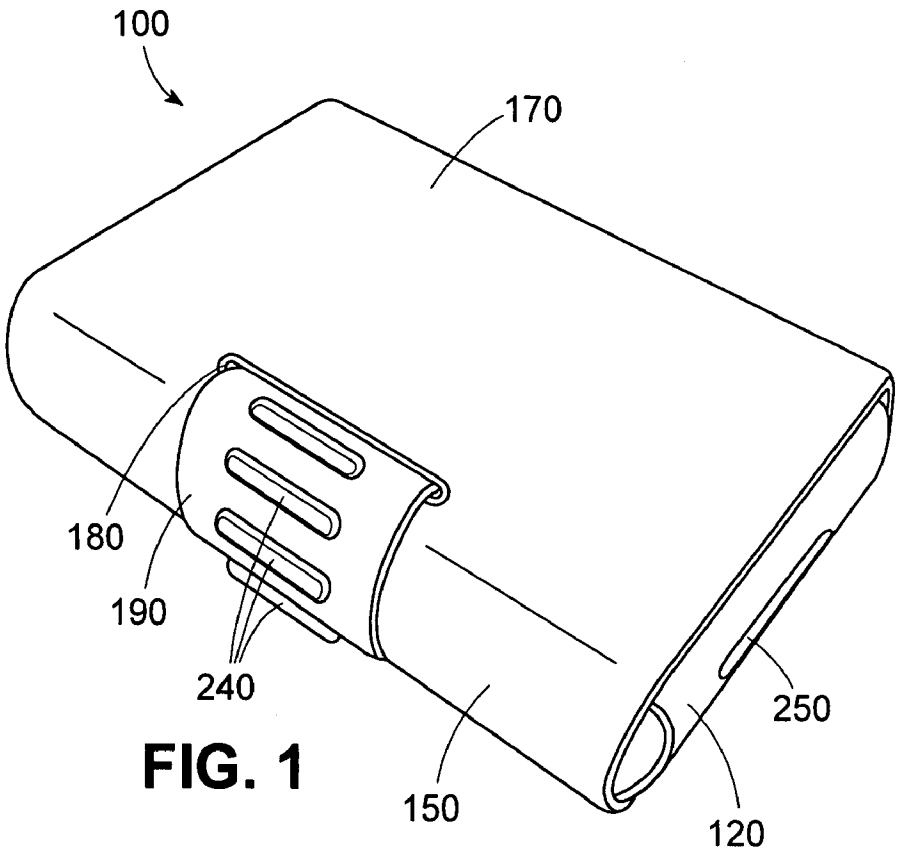
FIG. 1 is an isometric view of a holding device in a closed position according to an embodiment of the invention.
Figure 3:
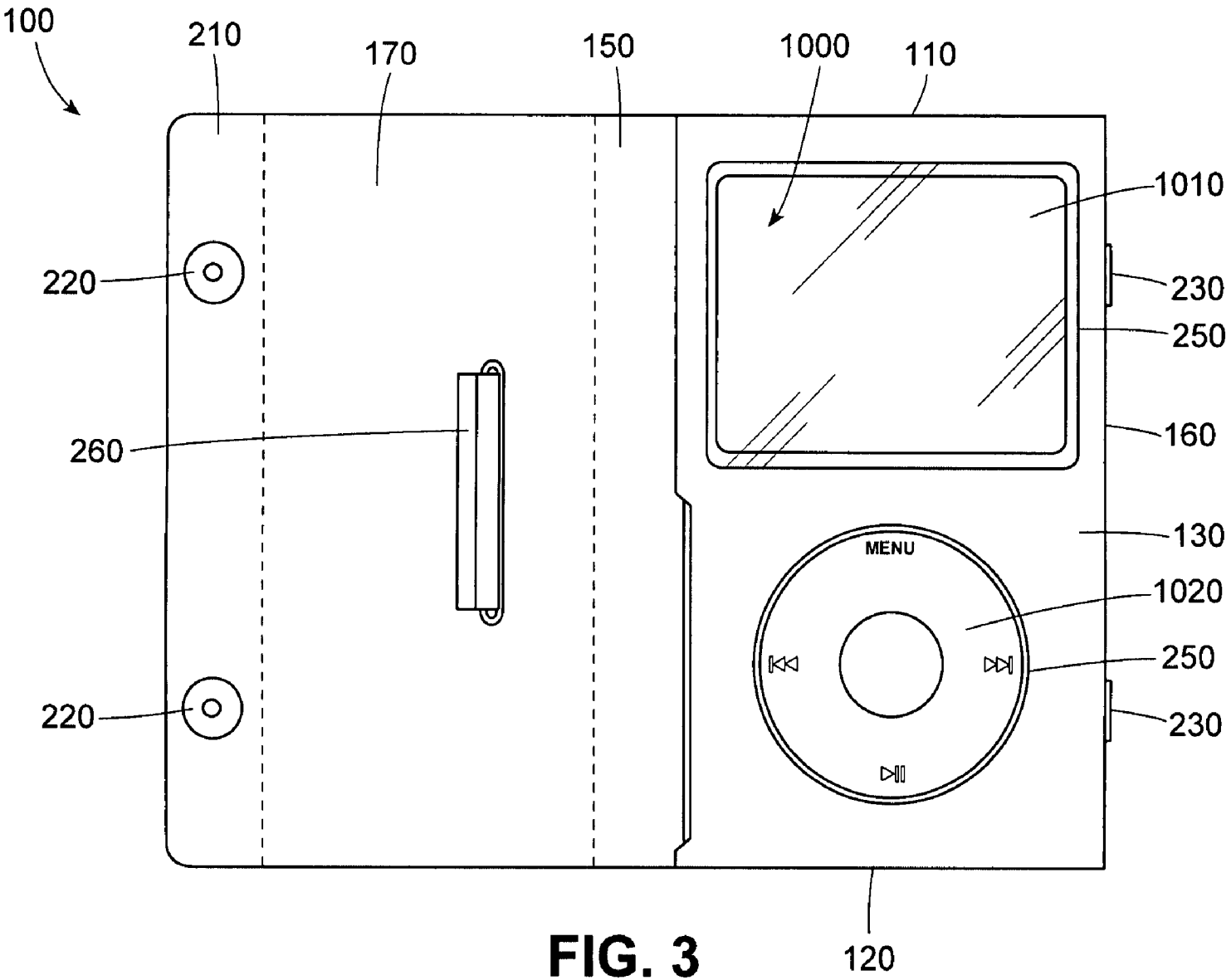
FIG. 3 is a view of the holding device of FIG. 1 in an open position from the top.
Figure 4:
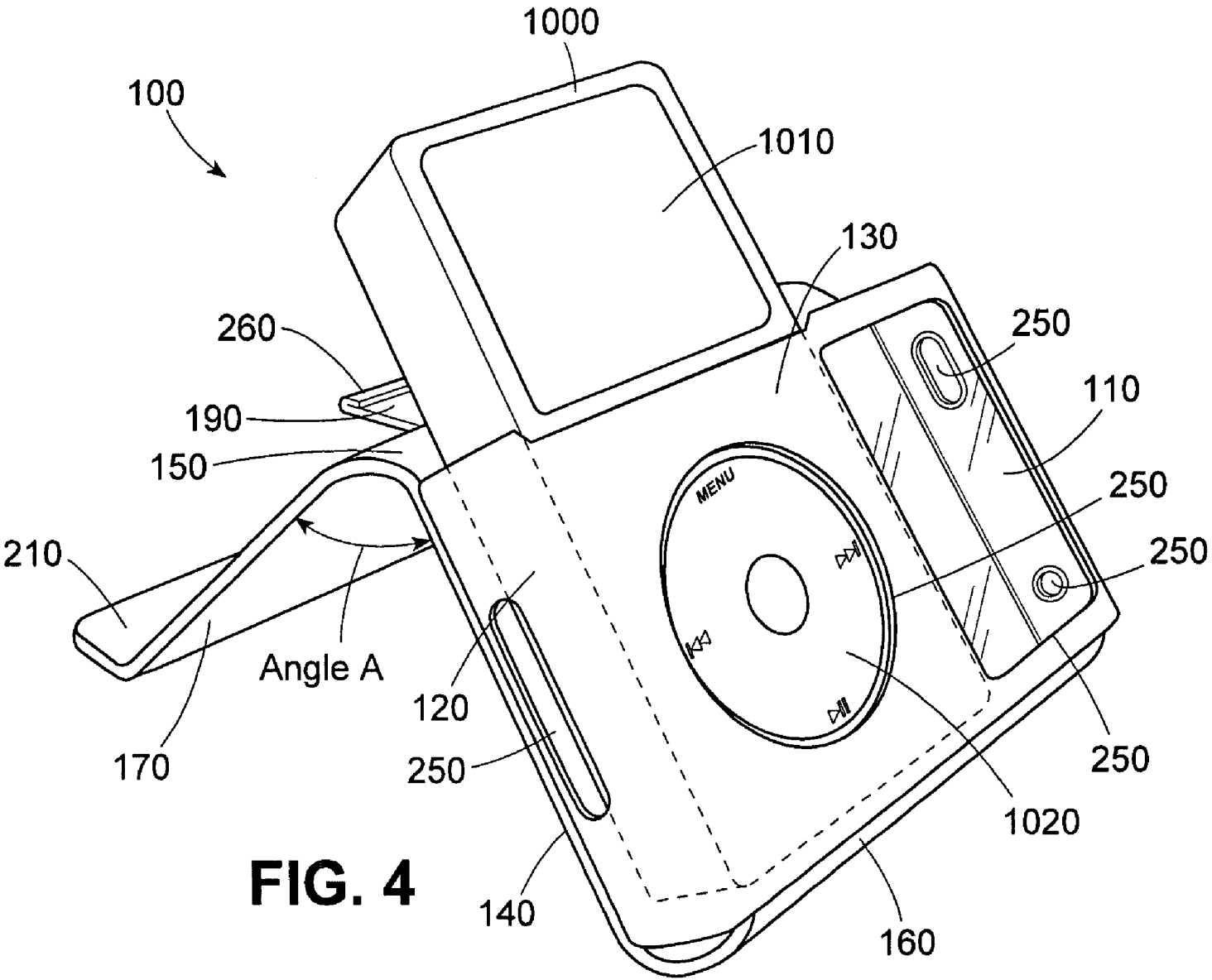
FIG. 4 is an isometric view of the holding device of FIG. 1 in the open position, where the holding device is holding a portable object.
Figure 5:
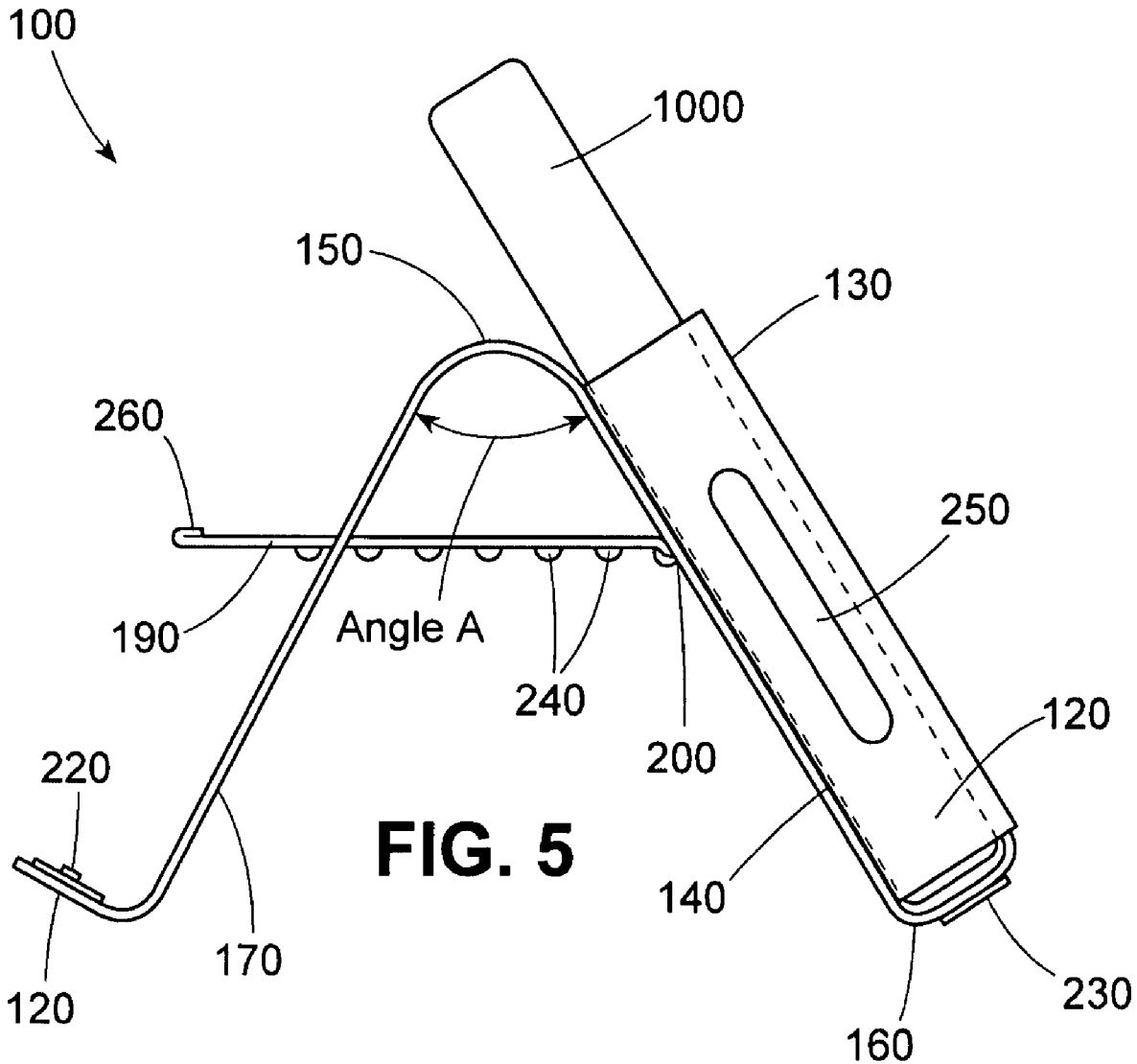
FIG. 5 is a view of the holding device of FIG. 1 in the open position from the left side, where the device is holding the portable object.

FIG. 1 is an isometric view of a holding device 100 in the closed position, and FIG. 2 is a view of the holding device in the closed position from the back according to an embodiment of the invention. As illustrated in FIGS. 1 and 2, the holding device 100 comprises a case with six sides, i.e., a top 110, a bottom 120, a front 130, a back 140, a left side 150, and a right side 160 coupled to form a rectangular prism adapted to receive a portable object 1000 (FIGS. 3, 4, and 5). The left side 150 is coupled to the back 140 of the case. An elongate flap 170 is continuous with the left side 150 of the case. There is a slot 180 through the elongate flap 170. In the illustrated embodiment, the slot 180 is substantially parallel to the left side 150. A tongue 190 is coupled to the back 140 of the case at an attachment point 200. The tongue 190 passes through the slot 180 in the elongate flap 170. The tongue 190 and the slot 180 are such that the tongue 190 frictionally engages the 180 slot using a friction mechanism. That is, the tongue 190 does not freely move through the slot 180, but rather, a force greater than the combined weight of the holding device 100 and the portable object 1000 (FIGS. 3, 4, and 5) is required to move the tongue 190 through the slot 180. In an embodiment of the invention, the friction mechanism includes one or more pliable ridges 240 disposed on the surface of and perpendicular to the length of the tongue 190, which provide the frictional engagement with the slot 180.

Attached to a fastener portion 210 of the elongate flap 170 opposite the left side 150 of the case are the male halves 220 of two fasteners, i.e., snaps. The male halves 220 of the snaps engage the female halves 230 of the fasteners, which are disposed on the right side 160 of the case, thus securing the left side 150 of the case and the elongate flap 170 when in the closed position. The bottom 120 of the case has a port 250 to allow access to a connection point on the portable object 1000.

The holding device 100 may be formed of any material capable of being molded or manufactured to enclose a portable object. Examples of materials useful in forming the holding device 100 include, but are not limited to polyurethane, rigid plastic, leather, canvas, nylon, metal, and combinations thereof. An embodiment of the holding device 100 of the invention is polyurethane.

The holding device 100 may be of any dimension useful to enclose a portable object 1000. Obviously, then, the dimensions of the portable object 1000 will dictate the dimensions of the holding device 100. Portable objects that can be used with the holding device 100 may be as small as the smallest cell phone or MP3 player and as large as or larger than a laptop computer. In an embodiment of the invention, the holding device is for an MP3 player, e.g., an iPod®.

The holding device 100, may also have one or more ports 250 in one or more of the sides of the holding device 100. Most portable objects will have numerous connection points, e.g., earphone jacks, charger jacks, data transfer jacks, universal serial bus (USB) ports, etc., control surfaces, e.g., scroll wheels, volume controls, on/off buttons, numeric pads, etc., and graphical displays. The holding device 100 may have ports 250 for any or all of these. The placement and size of the ports 250 will be dictated by the configuration of the portable object 1000.

The holding device 100, may employ any useful fastener. Fasteners useful in the holding device 100 include, but are not limited to, snaps, hook and loop fasteners, button and button holes, zippers, and magnetic closures. In an embodiment of the invention, the fastener is a snap (220/230).

In an embodiment of the invention, a first half of the fastener is disposed on a fastener portion 210 on an interior surface of the elongate flap 170 opposite the left side 150 of the case. The second half of the fastener is disposed on the exterior surface of the right side 160 of the case. Thus, when the holding device 100 is in the closed position, the first half of the fastener disposed on the fastener portion 210 of the elongate flap 170 may engage the second half of the fastener on the right side 160 of the case, securing the left side 150 of the case and the elongate flap 170 in the closed position.

Now turning to the embodiment of the holding device 100 in the open position, FIG. 3 is a view of the holding device 100 in the open position from the front; FIG. 4 is an isometric view of the holding device 100 in the open position; and FIG. 5 is a view of the holding device 100 in the open position from the left side. In the open position, the male and female snaps 220/230 are disengaged and the elongate flap 170 and the left side 150 of the case are freed. The elongate flap 170 and the left side 150 of the case are opened and folded towards the back 140 of the case. The elongate flap 170 and the left side 150 of the case and the back 140 of the case are positioned to form an angle A that is less than 180 degrees and greater than 0 degrees. The tongue 190 is moved through the slot 180 in the elongate flap 170 until taut (see FIG. 5). Thus, the frictional engagement between the tongue 190 and slot 180 maintains the desired angle A.

The friction mechanism of the present invention may be any interaction between the tongue 190 and the slot 180 that maintains the angle A against the force generated by the combined weight of the holding device 100 and the portable object 1000. The friction mechanism may, for example, may be provided by the choice of the width or height of the tongue 190 and the width or height of the slot 180, respectively. If these dimensions are almost the same, then the tongue 190 will directly frictionally engage the slot 180 without the need for any additional friction mechanism. Alternatively, a separate friction mechanism may be provided. For example, a pliable material may be disposed on one or both of the surfaces of the tongue 190. The height of the slot 180 may then be selected such that the pliable material must be compressed if the tongue 190 is to pass through the slot 180. Thus, without external force the tongue 190 is "stuck" in the desired position.

In an embodiment of the holding device 100, the pliable material is in the form of one or more ridges 240 perpendicular to the length of the tongue 190. Accordingly, the slot 180 may be trapped against one of the ridges 240, thereby maintaining the angle A against the weight of the holding device 100 and the portable object 1000. In addition, the pliable material may be continuous along the length of the tongue, thus providing for the choice of any angle A between 0 and 180 degrees.

The free end of the tongue 190 includes a stop 260 which has a height or width greater than the height or width, respectively, of the slot 180. Thus, the free end of the tongue 190 is unable to pass through the slot 180 and ensuring that the tongue 190 remains disposed in the slot 180. In an embodiment of the holding device 100, the height of the stop 260 is greater than the height of the slot 180. Preferably, the stop 260 is less pliable and more rigid than ridges 240.

The structure formed by the elongate flap 170 and the left side 150 of the case and the back 140 of the case when the holding device 100 in the open position provides a stable platform on which the portable object 1000 may be rested on a surface for hands-free operation and/or viewing. The graphical display 1010 may be positioned for optimum viewing or the control surfaces 1020 may be positioned for operation with only one hand. Moreover, the holding device 100 allows for the adjustment of the position of the portable object 1000, i.e., adjustment of angle A, if circumstances change, e.g., the light in the room changes and creates glare on the graphical display 1010, the portable object 1000 is moved to another place requiring a different position for comfortable viewing, or the function of the portable object 1000 is changed, for example, from a video or motion picture viewer to PDA or a phone.

In this embodiment, when the holding device 100 is in the open position, one side of the case is open. The side continuous with the elongate flap 170 is pulled out of the closed position exposing an entire side of the portable object 1000 when it is disposed in the holding device 100 and also allowing for removal of the portable object 1000. In addition, the portable object may be rotated within the holding device to provide the optimum position for the desired function. For example, FIG. 4 shows a portable object 1000 that has been rotated 90 degrees counterclockwise to place the graphical display 1010 in the upright position for viewing.

Moreover, any side of the case may be continuous with the elongate flap 170. Thus, the holding device 100 may be designed to hold the portable object 1000 in any desired position when open. For example, the figures illustrate a design in which the elongate flap 170 is continuous with the left side 150 of the case. When open and rested on a surface, this embodiment puts the right side 160 of the case facing downward with the front 130 of the case facing the user. In an alternative embodiment of the holding device 100, the elongate flap 170 may be continuous with the top 110 of the case. In such an embodiment, the bottom 120 of the case would face downward, and the front 130 of the case and the portable object would face the viewer in an upright position when open and rested on a surface.

Figure 6:
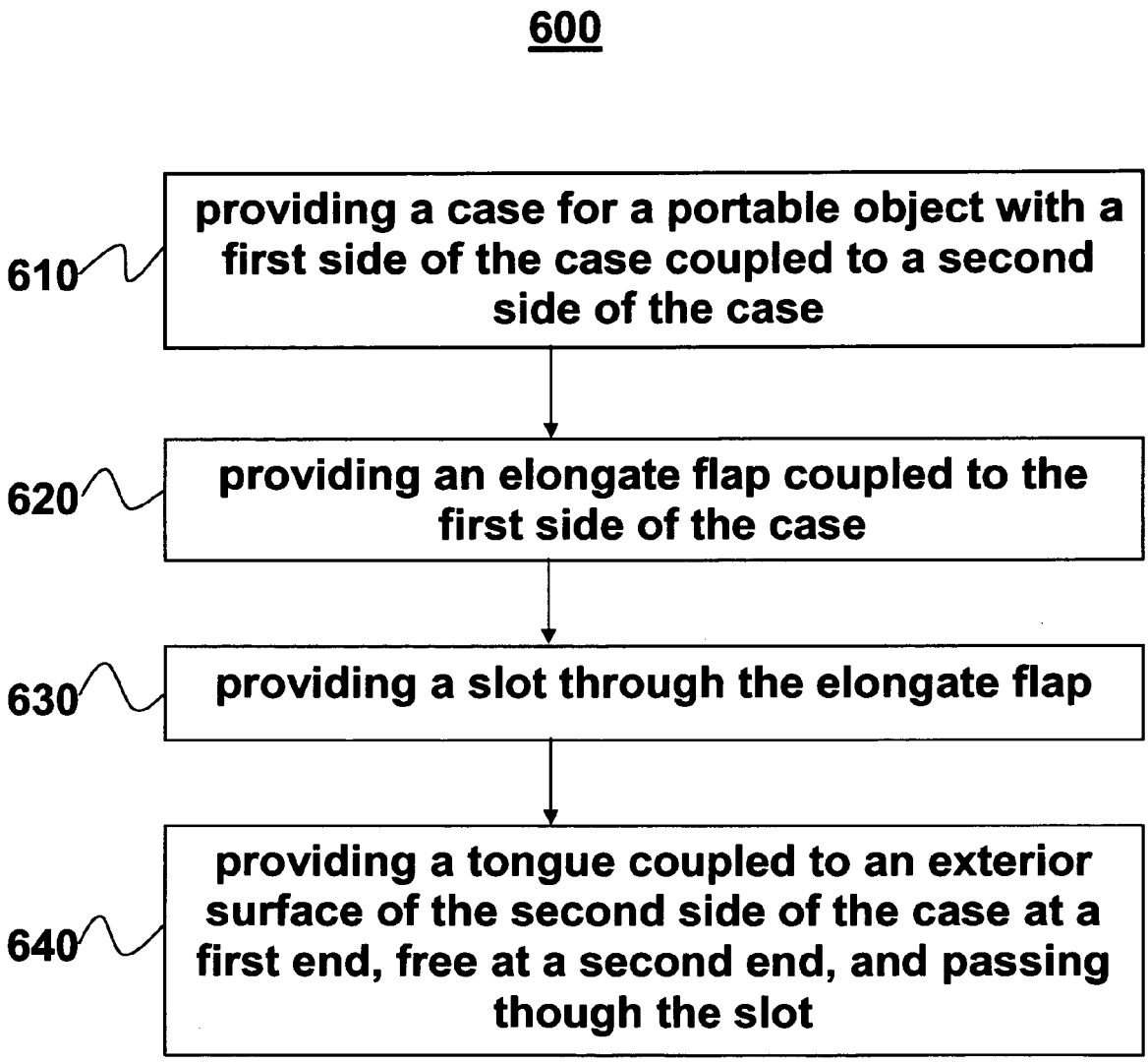
FIG. 6 is a flowchart illustrating a method of manufacturing a holding device according to an embodiment of the invention.

FIG. 6 is a flowchart illustrating a method 600 of manufacturing a holding device 100 according to an embodiment of the invention. A step 610 of the method 600 is to provide a case for a portable object with a first side of the case coupled to a second side of the case. As an example, the case can be similar to that shown in FIGS. 1-5.

A step 620 of the method 600 is to provide an elongate flap 170 coupled to the first side of the case. As an example, the elongate flap 170 can be similar to that shown in FIGS. 1-5.

A step 630 of the method 600 is to provide a slot 180 through the elongate flap 170. As an example, the slot 180 can be similar to that shown in FIGS. 1, 3, and 5.

A step 640 of the method 600 is to provide a tongue coupled to an exterior surface of the second side of the case at a first end, free at the second end, and passing through the slot 180. As an example, the tongue 190 can be similar to that shown in FIGS. 1-5.

Figure 7:
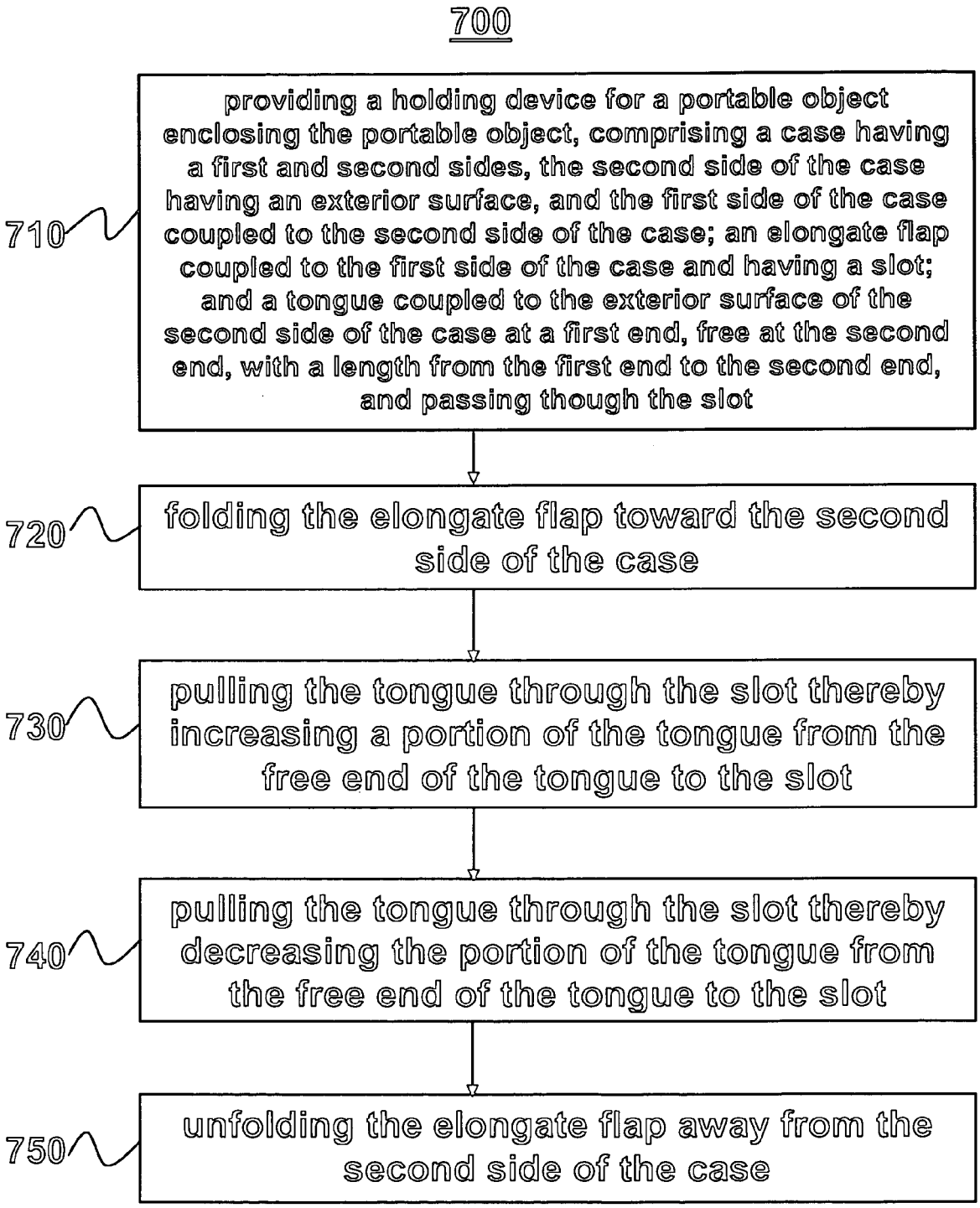
FIG. 7 is a flowchart illustrating a method of using a holding device according to an embodiment of the invention.

FIG. 7 is a flowchart illustrating a method 700 holding and positioning a portable object 1000 (FIGS. 3-5) using an embodiment of the invention. A step 710 of the method 700 is to provide a holding device 100 for a portable object enclosing the portable object 1000 (FIGS. 3-5), comprising a case having a first and second sides, the second side of the case having an exterior surface, and the first side of the case coupled to the second side of the case; an elongate flap 170 coupled to the first side of the case and having a slot 180; and a tongue 190 coupled to the exterior surface of the second side of the case at a first end, free at the second end with a length from the first end to the second end. As an example, the holding device 100 can be similar to that shown in FIGS. 1-5.

A step 720 of the method 700 is to fold the elongate flap 170 toward the second side of the case. As an example, the folded position of the elongate flap 170 can be similar to that shown in FIGS. 3-5.

A step 730 of the method 700 is to pull the tongue 190 through the slot 180 thereby increasing a portion of the tongue 190 from the free end of the tongue 190 to the slot 170. As an example, the portion of the tongue 190 from the free end of the tongue 190 to the slot 180 can be similar to that shown in FIG. 5.

A step 740 of the method 700 is to pull the tongue 190 through the slot 180 thereby decreasing the portion of the tongue 190 from the free end of the tongue 190 to the slot. As an example, the portion of the tongue 190 from the free end of the tongue 190 to the slot 180 can be similar to that shown in FIGS. 1 and 2.

A step 750 of the method 700 is to unfold the elongate flap 170 away from the second side of the case. As an example, the unfolded position of the elongate flap 170 can be similar to that shown in FIGS. 1 and 2.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the holding device discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention. As another example, the spacing between different ones of the ridges 240 can vary.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A holding device for holding and positioning a portable object, the holding device comprising:

a case for a portable object having a first and second sides, the second side of the case having an exterior surface, and the first side of the case coupled to the second side of the case;

an elongate flap coupled to the first side of the case and a slot; and a tongue coupled to the exterior surface of the second side of the case at a first end and free at the second end with a length from the first end to the second end;

wherein:

the tongue passes through and frictionally engages the slot;

when the case is open, a portion of the tongue from the slot to the free end is increased relative to when the case is closed, and the second side of the case and the elongate flap form an angle of less than 180 degrees, and the portion of the tongue remains routed through the slot when the case is open and when the case is closed.

2. The holding device of claim 1, wherein the tongue further comprises a friction mechanism to produce the frictional engagement of the slot.

3. The holding device of claim 2, wherein the friction mechanism comprises ridges perpendicular to the length of the tongue, wherein an angle between the elongate flap and the second side of the case is selected by increasing or decreasing a number of ridges between the second end of the tongue and the slot.

4. The holding device of claim 2, wherein the friction mechanism comprises a continuous raised area running along the length of the tongue, wherein an angle between the elongate flap and the second side of the case is selected by increasing or decreasing a portion of the tongue between the second end of the tongue and the slot.

5. The holding device of claim 1, wherein the case comprises six sides which form a generally rectangular prism shape adapted to enclose the portable object.

6. The holding device according to claim 1, wherein at least one side of the case has at least one port therein adapted to allow access to a control surface, a connection point, or a graphical display of the portable object when the portable object is enclosed in the case.

7. The holding device according to claim 1, wherein the holding device comprises a material selected from the group consisting of polyurethane, rigid plastic, leather, canvas, nylon, metal, and combinations thereof.

8. The holding device according to claim 7, wherein the holding device comprises polyurethane.

9. The holding device according to claim 1, wherein the elongate flap is continuous with the first side of the case.

10. A holding device for holding and positioning a portable object, the holding device comprising:

a case having six sides, each side having an exterior and an interior surface, and a first side of the case coupled to a second side of the case;

an elongate flap coupled to the first side of the case and having a slot;

a tongue coupled to the exterior surface of the second side of the case at a first end and free at the second end with a length from the first end to the second end; and a fastener, wherein:

the tongue passes through and frictionally engages the slot;

when closed:

the first side of the case is positioned to form, with the five other sides of the case, a rectangular prism adapted to enclose the portable object;

the elongate flap covers a side of the case that does not intersect with the second side of the case;

a first portion of the tongue from the first end to where the tongue passes through the slot conforms to a shape of the exterior surface of the case, and a second portion of the tongue from where it passes through the slot to the free end conforms to a shape of the interior surface of the case; and the fastener maintains the first side of the case and the elongate flap in the closed position;

and when open:

the second portion is increased compared to the second portion of the tongue in the closed position; and the elongate flap forms an angle of less than 180 degrees with the second side of the case that is maintained by frictional engagement of the slot by the tongue.

11. The holding device according to claim 10, wherein when the holding device is in the open position and resting on a surface, the elongate flap and the second side of the case maintain the angle so that the portable object therein is not parallel to the surface.

12. The holding device of claim 10, wherein the tongue further comprises a friction mechanism to produce the frictional engagement of the slot.

13. The holding device of claim 12, wherein the friction mechanism comprises ridges perpendicular to the length of the tongue, wherein the angle between the elongate flap and the second side of the case is selected by increasing or decreasing a number of ridges between the second end of the tongue and the slot.

14. The holding device of claim 12, wherein the friction mechanism comprises a continuous raised area running along the length of the tongue, wherein the angle between the elongate flap and the second side of the case is selected by increasing or decreasing a portion of the tongue between the second end of the tongue and the slot.

15. The holding device according to claim 10, wherein at least one side of the case has at least one port therein adapted to allow access to a control surface, a connection point, or a graphical display of the portable object when the portable object is enclosed in the case.

16. The holding device according to claim 10, wherein the holding device comprises a material selected from the group consisting of polyurethane, rigid plastic, leather, canvas, nylon, metal, and combinations thereof.

17. The holding device according to claim 16, wherein the holding device comprises polyurethane.

18. The holding device according to claim 10, wherein the slot is substantially parallel to the first side.

19. A method of manufacturing a holding device for holding and positioning a portable object, the method comprising:

providing a case for a portable object with a first side of the case coupled to a second side of the case;

providing an elongate flap coupled to the first side of the case;

providing a slot through the elongate flap; and providing a tongue coupled to an exterior surface of the second side of the case at a first end, free at a second end, and passing through the slot;

wherein:

providing the elongate flap comprises:

configuring the elongate flap to form an angle of less than 180 degrees with the second side of the case when the case is open;

and providing the tongue comprises:

configuring the tongue to frictionally engage the slot and to remain routed through the slot when the case is open and when the case is closed;

configuring a portion of the tongue, from the slot to the free end, to comprise a first length when the case is closed; and configuring the portion of the tongue to comprise a second length greater than the first length when the case is open.

20. The method of claim 19 further comprising:

providing a friction mechanism to produce a frictional engagement of the tongue with the slot.

21. The method of claim 20, wherein the friction mechanism comprises ridges perpendicular to the length of the tongue, wherein the angle between the elongate flap and the second side of the case is selected by increasing or decreasing a number of ridges between the second end of the tongue and the slot.

22. The method of claim 20, wherein the friction mechanism comprises a continuous raised area running along the length of the tongue, wherein the angle between the elongate flap and the second side of the case is selected by increasing or decreasing a portion of the tongue between the second end of the tongue and the slot.

23. The method of claim 19, further comprising:

providing at least one port in at least one side of the case, the port adapted to allow access to a control surface, a connection point, or a graphical display of the portable object when the portable object is enclosed in the case.

24. A method of holding and positioning a portable object, the method comprising:

providing a holding device for enclosing the portable object, the holding device comprising:

a case having a first and second sides, the second side of the case having an exterior surface, and the first side of the case coupled to the second side of the case;

an elongate flap coupled to the first side of the case and having a slot; and a tongue coupled to the exterior surface of the second side of the case at a first end and free at the second end, with a length from the first end to the second end, the tongue routed through and frictionally engaging the slot when the case is open and when the case is closed;

opening the case by:

folding the elongate flap toward the exterior surface of the second side of the case; and traversing the tongue through the slot thereby increasing a portion of the tongue from the free end of the tongue to the slot;

closing the case by:

traversing the tongue through the slot thereby decreasing the portion of the tongue from the free end of the tongue to the slot; and unfolding the elongate flap away from the second side of the case.

25. The method of claim 24 further comprising:

using a friction mechanism to produce a frictional engagement of the tongue with the slot.

26. The method of claim 25, wherein the friction mechanism comprises ridges perpendicular to the length of the tongue, wherein an angle between the elongate flap and the second side of the case is selected by increasing or decreasing a number of ridges between the second end of the tongue and the slot.

27. The method of claim 26, wherein each of the pulling steps further comprises compressing one or more of the ridges.

28. The method of claim 25, wherein the friction mechanism comprises a continuous raised area running along the length of the tongue, wherein an angle between the elongate flap and the second side of the case is selected by increasing or decreasing a portion of the tongue between the second end of the tongue and the slot.

29. The method of claim 28, wherein each of the pulling steps further comprises compressing a portion of the raised area.

30. The method of claim 24, further comprising:

resting the holding device and the portable object on a surface after the first pulling step.

31. The method of claim 24 wherein the holding device further comprises at least one fastener, further comprising:

unfastening the fastener before the folding step; and fastening the fastener after the unfolding step.

32. The method of claim 24, further comprising:

rotating the portable object to achieve a desired position after the first pulling step; and rotating the portable object to place it in a storage position before the second pulling step.

* * * * *

UNITED STATES PATENT AND TRADEMARK OFFICE

CERTIFICATE OF CORRECTION

PATENT NO. : 7,584,841 B2
APPLICATION NO. : 11/649969
DATED : September 8, 2009
INVENTOR(S) : Chan et al.

It is certified that error appears in the above-identified patent and that said Letters Patent is hereby corrected as shown below:

At claim 1 (column 6, line 59), insert the word --having-- after the text "... the first side of the case and".

Signed and Sealed this

Twenty-ninth Day of December, 2009

David J. Kappos

David J. Kappos
*Director of the United States Patent and Trademark Office*